US008341992B2

(12) United States Patent
Vanimisetti et al.

(10) Patent No.: US 8,341,992 B2
(45) Date of Patent: Jan. 1, 2013

(54) ROLLER HEMMING WITH IN-SITU ADHESIVE CURING

(75) Inventors: Sampath K. Vanimisetti, Karnataka (IN); Rajesh Raghavan, Karnataka (IN); John E. Carsley, Clinton Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 311 days.

(21) Appl. No.: 12/774,242

(22) Filed: May 5, 2010

(65) Prior Publication Data

US 2011/0271728 A1 Nov. 10, 2011

(51) Int. Cl.
*B21D 7/02* (2006.01)

(52) U.S. Cl. ..... 72/114

(58) Field of Classification Search ..... 72/210, 72/214, 128, 215, 220; 29/243.58
See application file for complete search history.

(56) References Cited

U.S. PATENT DOCUMENTS

| | | | | |
|---|---|---|---|---|
| 5,403,994 | A | 4/1995 | Havas et al. | |
| 5,897,796 | A * | 4/1999 | Forrest | 219/121.64 |
| 6,002,118 | A | 12/1999 | Kawano et al. | |
| 6,288,375 | B1 | 9/2001 | Lappi et al. | |
| 6,576,878 | B2 | 6/2003 | Thorpe et al. | |
| 7,290,423 | B2 | 11/2007 | Carsley et al. | |
| 8,042,372 | B2 * | 10/2011 | Carsley et al. | 72/342.94 |
| 2008/0000071 | A1 | 1/2008 | Chen et al. | |

FOREIGN PATENT DOCUMENTS

| | | | |
|---|---|---|---|
| JP | 6-285659 | * | 6/1996 |
| JP | 2004-167525 | * | 6/2004 |

* cited by examiner

*Primary Examiner* — Faye Francis
(74) *Attorney, Agent, or Firm* — Quinn Law Group, PLLC

(57) ABSTRACT

An apparatus for hemming multiple panels includes an anvil having a first panel and a second panel supported thereon. A roller mechanism and a curing mechanism are mounted to the hemming apparatus. The roller mechanism is adapted to move relative to the panels to fold a flanged portion of the first panel onto an edge portion of the second panel to form a joint. The curing mechanism is adapted to move relative to the panels to cure an adhesive located within the joint formed between the first panel and the second panel. The curing mechanism is located proximate to the roller mechanism, such that the first panel and the second panel may be supported by the anvil while the curing mechanism at least partially cures the adhesive.

14 Claims, 2 Drawing Sheets

ROLLER HEMMING WITH IN-SITU ADHESIVE CURING

TECHNICAL FIELD

The present invention relates to hemming operations for sheet metal panels.

BACKGROUND OF THE INVENTION

Multiple panels of material, in particular sheet metal, may be secured to one another by a hemming arrangement. Hemming is frequently used in automotive applications to join panels together, i.e. to form the body of a vehicle. Typically, a flange on one panel of material is folded over a corresponding edge on another panel. One common form of hemming for joining the panels is roller hemming. Roller hemming uses a roller to bend the flange on one panel over the edge on the other panel.

Adhesive is typically applied between the panels to strengthen the hem joint. The adhesive must be cured to prevent relative motion between the panels. However, during assembly of vehicles, curing of the adhesive may not occur until assembly of the vehicle body is complete. Therefore, to prevent shifting of the panels during the assembly operation, curing stations are typically located adjacent to the hemming stations to reduce the amount of relative motion between the panels after the hemming has occurred.

SUMMARY OF THE INVENTION

An apparatus for hemming a first panel having a flange and a second panel having an edge portion includes an anvil. The first panel and the second panel are supported on the anvil. A roller mechanism is mounted to the hemming apparatus and is adapted to be moved relative to the panels to fold the flange of the first panel over the edge portion of the second panel. A curing mechanism is also mounted to the hemming apparatus and is adapted to be moved relative to the panels along the flange to cure an adhesive located within the joint formed between the first panel and the second panel. The curing mechanism is located proximate to the roller mechanism, such that the first panel and the second panel may be supported by the anvil while the curing mechanism at least partially cures the adhesive.

A method for hemming multiple panels together includes supporting a first panel and a second panel on an anvil for a hemming apparatus. A flange of the first panel and an edge portion of the second panel are traversed with a roller mechanism, such that the roller mechanism folds the flange of the first panel over the edge portion of the second panel. Then the joint is traversed with a curing mechanism while the first panel and the second panel are supported on the anvil, to at least partially cure an adhesive located within the joint between the first panel and the second panel.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
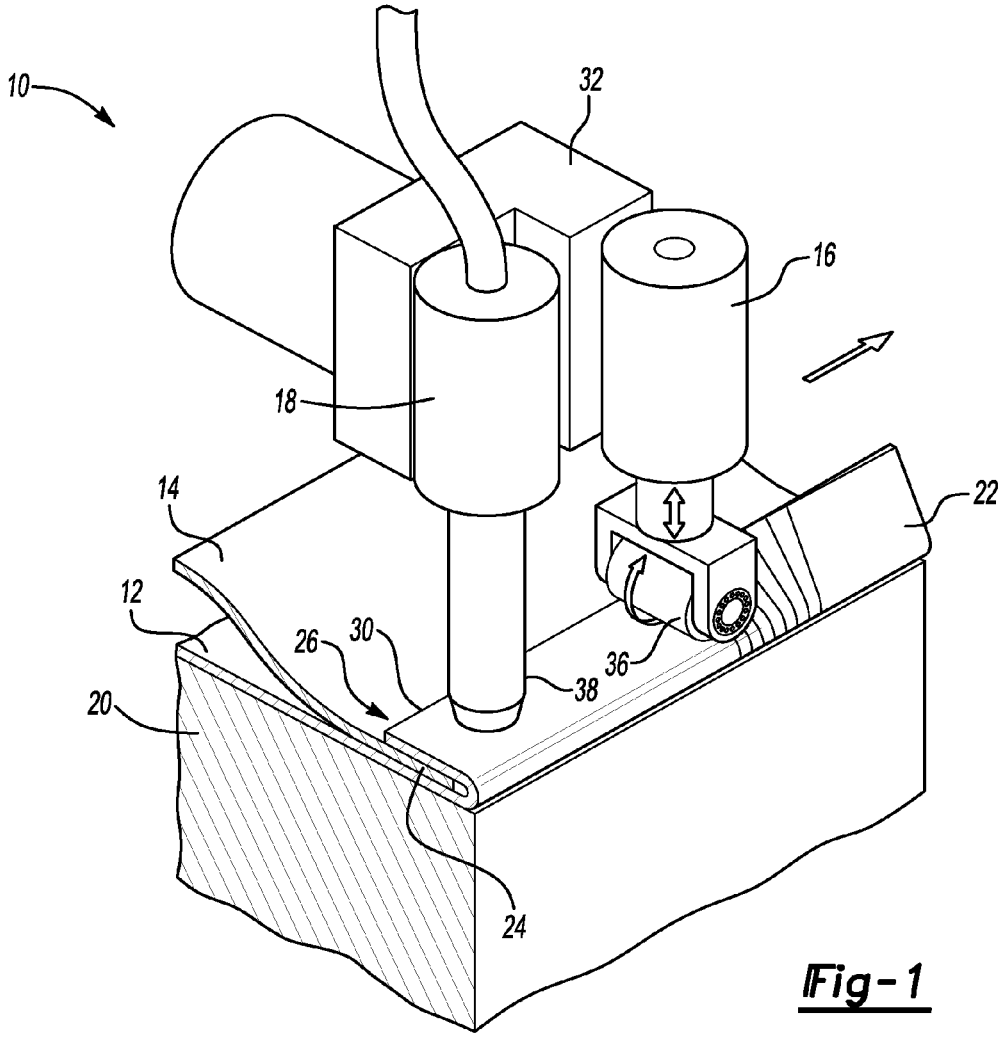
FIG. 1 is a schematic partially cross-sectional perspective view of a first embodiment of a hemming apparatus having a roller mechanism and a curing mechanism for hemming and curing multiple panels of material.

Referring to the Figures, wherein like reference numbers refer to the same or similar components throughout the several views, FIG. 1 schematically illustrates a hemming apparatus 10 for hemming a first panel 12 and a second panel 14. The hemming apparatus 10 includes a roller mechanism 16 and a curing mechanism 18. An anvil 20 is located proximate to the roller mechanism 16 and the curing mechanism 18 for supporting the first panel 12 and the second panel 14 during the hemming and curing process.

The first panel 12 defines a flange 22, which is arranged in an angular relationship with the remaining portion of the first panel 12. In the embodiment shown in FIG. 2, prior to hemming, the flange 22 is in a generally perpendicular arrangement relative to the remaining portion of the first panel 12 to assist in placing the first panel 12 and the second panel 14 on the anvil 20 at the desired locations relative to one another. The flange 22 may be arranged at other angles. One skilled in the art would be able to determine the appropriate angle for the flange 22 for a particular hemming apparatus 10 and panel 12

Figure 2:
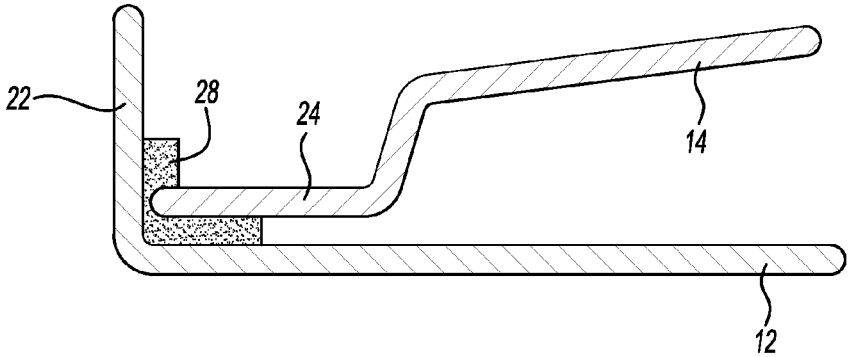
FIG. 2 is a schematic cross-sectional illustration of a first and second panel prior to hemming with the hemming apparatus of FIG. 1.

The second panel 14 defines an edge portion 24 that is located about the circumference of the second panel 14 and extends for a distance inward from the edge toward the remaining portion of the second panel 14. During the hemming process, the flange 22 of the first panel 12 is folded over the edge portion 24 of the second panel 14 to form a joint 26. Referring to FIG. 2, adhesive 28 may be placed on the first panel 12, the second panel 14, or both prior to hemming the first panel 12 and the second panel 14 together. The adhesive 28 is preferably a thermoset adhesive 28 that may be cured, or partially cured by applying heat. In one embodiment, the first panel 12 is an outer panel and the second panel 14 is an inner panel, such that when the hemming process is complete the seam 30 formed between the flange 22 and the second panel 14 is located on an inward side of the first panel 12 and the second panel 14 for aesthetic purposes.

In the embodiment shown in FIG. 1, the roller mechanism 16 and the curing mechanism 18 are both mounted to a first mount 32 for the hemming apparatus 10. The first mount 32 is preferably a multi-axis manipulator which moves in three-dimensions relative to the anvil 20 to control the location of the roller mechanism 16 and the curing mechanism 18 relative to the first panel 12 and the second panel 14. Additionally, the anvil 20 may also move relative to the hemming apparatus 10 to assist in moving the first panel 12 and the second panel 14 relative to the roller mechanism 16 and the curing mechanism 18. In the embodiment shown, the anvil 20 may rotate the first panel 12 and the second panel 14 while the roller mechanism 16 and the curing mechanism 18 move to fold and cure the joint 26.

The roller mechanism 16 includes a roller 36. The roller 36 may be adjustable in height relative to the first mount 32 to maintain even pressure on the flange 22 and to assist in accommodating any changing geometry of the first panel 12 and the second panel 14, as indicated by the arrows in FIG. 1, which illustrate the motion of the roller mechanism 16. The roller 36 may also be adjusted angularly relative to the curing mechanism 18. That is, the roller mechanism 16 may require several applications of the roller 36 to the flange 22 to properly form the joint 26. The angular position of the roller 36 may be adjusted each time the roller mechanism 16 traverses the flange 22. Adjusting the angular position of the roller 36 allows the roller mechanism 16 to at least partially bend the flange 22 on each pass until the flange 22 is generally flat against the edge portion 24 on the final pass. The curing mechanism 18 may be separately activated relative to the roller mechanism 16. If multiple passes of the roller mechanism 16 are utilized, the curing mechanism 18 may be activated only during the last time the roller mechanism 16 traverses the length of the flange 22. Additionally, to accommodate the multiple passes of the roller mechanism 16, the curing mechanism 18 may be retractable relative to the roller mechanism 16.

The roller mechanism 16 may also be detachable from the first mount 32 to accommodate use of different rollers 36 with the hemming apparatus 10. The different roller mechanisms 16 may be located proximate to the hemming apparatus 10 to allow the hemming apparatus 10 to robotically exchange the roller mechanisms 16. Alternatively, the roller mechanism 16 may include multiple rollers 36 each arranged at a different angle to at least partially bend the flange 22. Therefore, the roller mechanism 16 is required to make only a single pass along the flange 22. In this instance, the curing mechanism 18 may traverse the joint 26 and at least partially cure the adhesive 28 following the traversal by the roller mechanism 16. The distance between the curing mechanism 18 and the roller mechanism 16 may also be adjusted as desired. Additionally, if multiple roller mechanisms 16 are utilized they may be re-positioned relative to one another in height, lateral position, or angular position.

In the embodiment shown in FIG. 1, the curing mechanism 18 includes a local heating device 38 which applies heat to the adhesive 28 once the flange 22 has been folded over the edge portion 24 to form the joint 26 and prior to the first panel 12 and the second panel 14 being moved from the anvil 20. The curing mechanism 18 may further include an electrical system (not shown) to control the intensity and duration of heat applied by the local heating device 38. The local heating device 38 at least partially cures the adhesive 28 when the curing mechanism 18 traverses the joint 26 to assist in reducing relative movement between the first panel 12 and the second panel 14. Therefore, the adhesive 28 for the joint 26 is at least partially cured immediately after the hemming. Curing the joint 26 occurs "in-situ", i.e. in the same location the hemming occurred. While the first panel 12 and the second panel 14 are not removed from the anvil 20 prior to curing, the first panel 12 and the second panel 14 may be moved to a new position by moving or rotating the anvil 20.

The local heating device 38 may be any type of flash heating device that is able to apply heat to at least partially cure the adhesive 28 and that may be supported on a first mount 32 that is moveable by a multi-axis manipulator. The local heating device 38 may be, for example, an induction heating coil, a laser heating device, a flame heating device, an infrared heating device, a resistive heating device, a heated forced air device, or a magnetic flux heating device. One skilled in the art would be able to select the proper curing mechanism 18 and the local heating device 38 based upon the application of the hemming apparatus 10, the material of the first panel 12 and the second panel 14 and the type of adhesive 28 which is to be cured.

As mentioned above, the curing mechanism 18 may be retractable relative to the roller mechanism 16 such that the curing mechanism 18 may be deployed or retracted during different passes of the roller mechanism 16 or used intermittently to cure the adhesive 28 at specific locations only. Alternatively, the curing mechanism 18 may be detachable from the first mount 32. Detaching the curing mechanism 18 from the first mount 32 would allow the local heating device 38 to be replaced allowing different heating methods to be used with one hemming apparatus 10. The alternative curing mechanisms 18 may be located proximate to the hemming apparatus 10 to allow the hemming apparatus 10 to robotically exchange the curing mechanisms 18.

Alternatively, multiple curing mechanisms 18 may be secured to the hemming apparatus 10. The multiple curing mechanisms 18 may have the same type of heating devices 38 or different types from one another. The distance between the curing mechanisms 18 and the roller mechanism 16 may be adjusted as desired. Additionally, if multiple rolling mechanisms 16 are utilized they may be re-positioned relative to one another in height, angular position, or lateral position.

The curing mechanism 18 may apply sufficient heat to at least partially cure the adhesive 28 along a substantial length of the joint 26. Alternatively, the curing mechanism 18 may apply discontinuous heat to the adhesive 28 to at least partially cure discrete portions of the adhesive along the length of the joint 16. The length of the joint 26 may extend around an entire periphery of the first panel 12 and the second panel 14 or may only extend along a portion of the periphery of the first panel 12 or the second panel 14. The curing mechanism 18 traverses the joint 26 and applies heat while the first panel 12 and the second panel 14 are supported by the anvil 20. Curing the adhesive 28 prior to moving the first panel 12 and the second panel 14 reduces shifting of the first panel 12 and the second panel 14 relative to one another.

The adhesive 28 may be fully cured at a later time by known curing methods. For example, if the first panel 12 and the second panel 14 are automotive body panels the curing mechanism 18 may partially cure the adhesive 28 when the first panel 12 and the second panel 14 are hemmed and supported by the anvil 20. However, the adhesive may not be fully cured until the body of the vehicle 10 is fully assembled.

Figure 3:
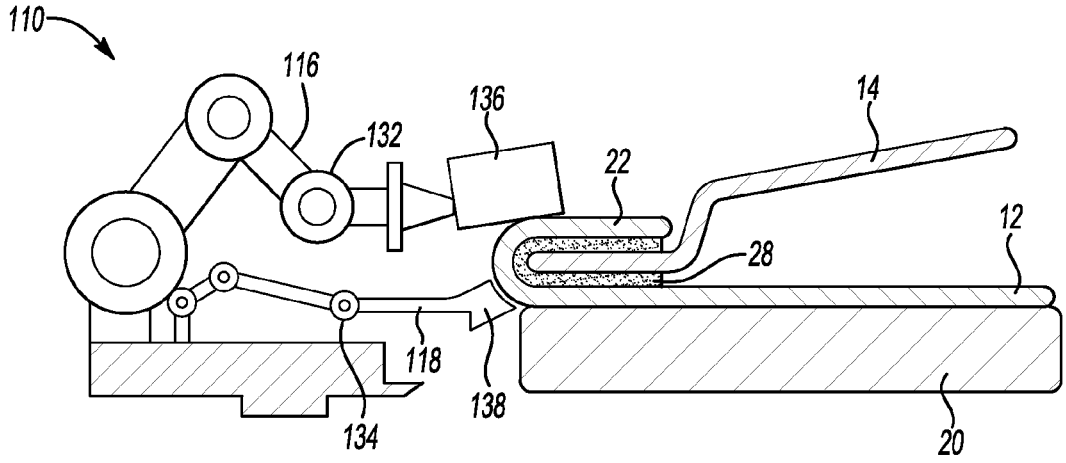
FIG. 3 is a schematic partially cross-sectional side view of a second embodiment of a hemming apparatus having a roller mechanism and a curing mechanism for hemming and curing multiple panels of material.

FIG. 3 illustrates a second embodiment of a hemming apparatus 110 for hemming the first panel 12 and the second panel 14. The hemming apparatus 110 includes a roller mechanism 116 and a curing mechanism 118. An anvil 20 is located proximate to the roller mechanism 116 and the curing mechanism 118 for supporting the first panel 12 and the second panel 14 during the hemming and curing process.

In the embodiment shown in FIG. 3, the roller mechanism 116 is mounted to a first mount 132 and the curing mechanism 118 is mounted to a second mount 134. The first mount 132 and the second mount 134 are preferably multi-axis manipulators which move in three-dimensions relative to the anvil 20 to control the location of the roller mechanism 116 and the curing mechanism 118 relative to the first panel 12 and the second panel 14. The first mount 132 may be controlled independently of the second mount 134. Additionally, the anvil 20 may also move relative to the hemming apparatus 110 to assist in moving the first panel 12 and the second panel 14 relative to the roller mechanism 116 and the curing mechanism 118.

In the embodiment shown, the roller mechanism 116 includes a roller 136. The roller 136 may be adjustable in height relative to the first mount 132 to maintain even pressure on the flange 22 and to assist in accommodating any changing geometry of the first panel 12 and the second panel 14. The angular position of the roller 136 may be adjusted each time the roller mechanism 116 traverses the flange 22. For example, by controlling the angle of the first mount 132 relative to the first panel 12 and the second panel 14. Adjusting the angular position of the roller 136 allows to the roller mechanism 116 to at least partially bend the flange 22 on each pass until the flange 22 is generally flat against the edge portion 24 on the final pass. The curing mechanism 118 may be separately activated relative to the roller mechanism 116. As in the embodiment described above, the curing mechanism 118 may be activated only during the last pass of the roller mechanism 116.

Alternatively, the roller mechanism 116 may include multiple rollers 136 each arranged at a different angle to at least partially bend the flange 22. Therefore, the roller mechanism 116 is required to make only a single pass along the flange 22. However, the curing mechanism 118 may still be independently controlled and movement may occur at a rate and time that is different than that of the roller mechanism 116.

The local heating device 138 typically applies heat to the adhesive 28 once the flange 22 has been folded over the edge portion 24 to form the joint 26 and prior to the first panel 12 and the second panel 14 being moved from the anvil 20. However, the local heating device 138 may at least partially cure the adhesive 28 concurrently with the rolling mechanism 116 during any pass, or may make a later independent pass. The local heating device 138 at least partially cures the adhesive 28 to assist in reducing relative movement between the first panel 12 and the second panel 14. The adhesive 28 may be fully cured at a later time by known curing methods. The local heating device 138 may be any flash heating device that is able to at least partially cure the adhesive 28 and that may be supported on a second mount 134 that is moveable by a multi-axis manipulator. One skilled in the art would be able to select the proper curing mechanism 118 and local heating device 138 based upon the application of the hemming apparatus 110, the material of the first panel 12, and the second panel 14, and the type of adhesive 28 which is to be cured.

Both the roller mechanism 116 and the curing mechanism 118 may be detachable from the hemming apparatus to allow replacement of the roller 136 or local heating device 138. Additionally, the first mount 132 and the second mount 134 may each support multiple roller mechanisms 116 and curing mechanisms 118, respectively. If multiple roller mechanisms 116 or curing mechanisms 118 are utilized they may be repositioned relative to another in height, angular position, lateral position, or retractable.

Figure 4:
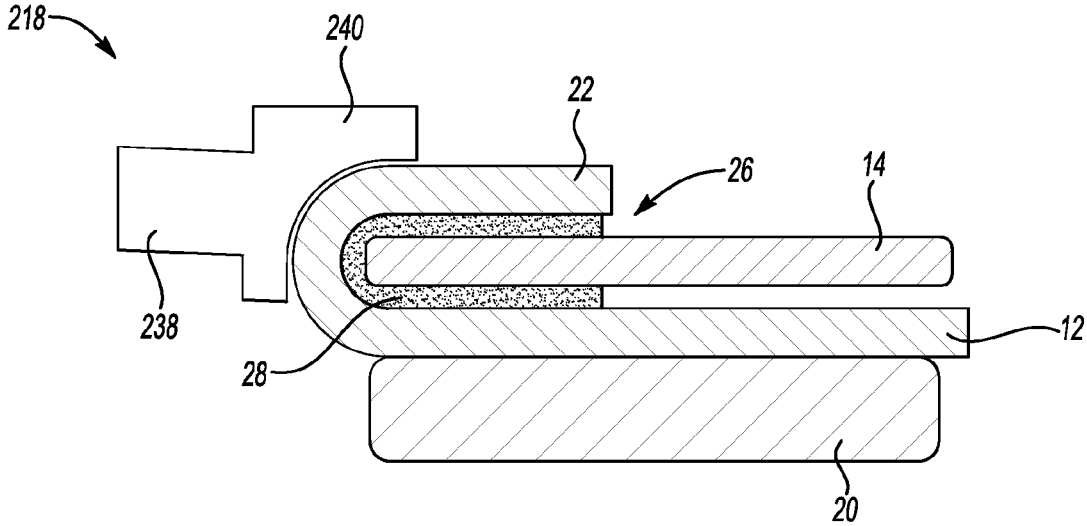
FIG. 4 is a schematic partially cross-sectional side view of a first embodiment of a curing mechanism for the hemming apparatuses of FIGS. 1 and 3.

FIG. 4 illustrates a curing mechanism 218 having a local heating device 238. The local heating device 238 may be used with a hemming apparatus 10 as illustrated in FIG. 1 or the hemming apparatus 110 as illustrated in FIG. 3. The local heating device 238 includes an induction coil 240. The induction coil 240 may be any type of induction coil, including a hair-pin coil, a split-return coil, and a transverse flux induction coil.

The coil 240 is positioned to at least partially surround the joint 26. The first panel 12 and the second panel 14 are positioned on the anvil 20 in a manner that allows the coil 240 to access the joint 26 from multiple angles. The coil 240 may be able to access a substantial portion of the joint 26 at one time while only applying heat to a partial portion of the joint 26. The coil 240 may apply heat to at least partially cure a portion of the adhesive 28 within the joint 26.

If additional curing or if applying heat to a greater portion of the joint 26 is required the coil 240 may make an additional pass over the joint 26, or additional coils 240 located at various angular positions may be used. A control circuit (not shown) may control the intensity and duration of the heat applied by the local heating device 238. The curing mechanism 218 may apply discontinuous heat to the adhesive 28 to at least partially cure a discrete portion of the adhesive along the length of the joint 26.

While the best modes for carrying out the invention have been described in detail, those familiar with the art to which this invention relates will recognize various alternative designs and embodiments for practicing the invention within the scope of the appended claims.

The invention claimed is:

1. An apparatus for hemming a first panel having a flange and a second panel having an edge portion, the apparatus comprising:

an anvil having the first panel and the second panel supported thereon;

a roller mechanism mounted to a first mount and adapted to be moved relative to the first panel and the second panel to fold the flange of the first panel over the edge portion of the second panel to form a joint while the panels are supported on the anvil;

a curing mechanism mounted to a second mount and adapted to be moved relative to the first panel and the second panel along the folded flange to cure an adhesive located within the joint formed between the first panel and the second panel; and wherein the curing mechanism is located proximate to the roller mechanism, such that the curing mechanism at least partially cures the adhesive after the roller mechanism forms the joint and while the panels are supported on the anvil.

2. The apparatus of claim 1, wherein the first mount is a multi-axis manipulator for moving the roller mechanism and wherein the second mount is a multi-axis manipulator for moving the curing mechanism, and wherein the second mount may he moved independently of the first mount.

3. The apparatus of claim 1, wherein the roller mechanism is detachable from the first mount and the curing mechanism is detachable from the second mount.

4. The apparatus of claim 1, wherein the curing mechanism is a flash heating device including at least one of an induction heating coil, a laser heating device, a flame heating device, an infrared heating device, a resistive heating device, a heated forced air device, and a magnetic flux heating device.

5. The apparatus of claim 4, wherein the curing mechanism is an induction heating coil having at least one of a hair-pin coil, a split-return coil, and a transverse flux coil.

6. The apparatus of claim 1, wherein the roller mechanism includes a plurality of rollers each of which bends the flange of the first panel at least partially onto the edge portion of the second panel as the roller mechanism traverses the first panel and the second panel.

7. A hemming apparatus for joining multiple panels comprising:

an anvil configured to support a first panel and a second panel thereon; a roller mechanism mounted to a first mount and adapted to be moved relative to the panels to fold a flange of the first panel onto an edge portion of the second panel to form a joint;

a curing mechanism mounted to the first mount and adapted to be moved relative to the panels along the folded flange to cure an adhesive located within the joint formed between the first panel and the second panel; and wherein the cluing mechanism at least partially cures the adhesive after the roller mechanism forms the joint and while the first panel and the second panel are supported by the anvil.

8. The hemming apparatus of claim 7, wherein the first mount is attached to a multi-axis manipulator for moving the roller mechanism and the curing mechanism relative to the first panel and the second panel.

9. The henuning apparatus of claim 7, wherein the roller mechanism includes a roller; and wherein the roller mechanism is mounted to the first mount such that the roller may be adjusted in at least one of height, lateral position, and angular position relative to the curing mechanism.

10. The hemming apparatus of claim 7, wherein the roller mechanism and the curing mechanism are detachable from the first mount.

11. The hemming apparatus of claim 7, wherein the curing mechanism includes a heating device; and wherein the curing mechanism is mounted to the first mount such that the heating may be adjusted in at least one of height, lateral position, and angular position, and retracted relative to the roller mechanism.

12. The hemming apparatus of claim 7, wherein the curing mechanism is a flash heating device including at least one of an induction heating coil, a laser heating device, a flame heating device, an infrared heating device, a resistive heating device, a heated forced air device, and a magnetic flux heating device.

13. The apparatus of claim 12__ wherein the curing mechanism is an induction heating coil having at least one of a hair-pin coil, a split-return coil, and a transverse flux coil.

14. The hemming apparatus of claim 7, wherein the roller mechanism includes a plurality of rollers each of which bends the flange of the first panel at least partially onto the edge portion of the second panel as the roller mechanism traverses the first panel and the second panel.

* * * * *